US005582362A

United States Patent [19]

Johnson et al.

[11] Patent Number: 5,582,362

[45] Date of Patent: Dec. 10, 1996

[54] CENTER FEED TOILET PAPER DISPENSER

[76] Inventors: John R. Johnson, 1612 Clearbrook, Allen, Tex. 75002; James A. Hall, 37402 Robin George, Pinehurst, Tex. 77362

[21] Appl. No.: 414,311

[22] Filed: Mar. 31, 1995

[51] Int. Cl.[6] ..... B65H 16/02

[52] U.S. Cl. ..... 242/593

[58] Field of Search ..... 242/423, 423.1, 242/593; 225/39, 51, 52, 79, 81; 206/406, 407, 408, 409

[56] References Cited

U.S. PATENT DOCUMENTS

| | | | |
|---|---|---|---|
| 1,819,122 | 8/1931 | Resnati | 242/593 |
| 3,523,653 | 4/1970 | Hansen | 242/593 |
| 3,627,216 | 12/1971 | Ekuan | 242/593 |
| 4,936,452 | 6/1990 | Pauley | 225/52 |
| 5,065,924 | 11/1991 | Granger | 225/46 |
| 5,100,038 | 3/1992 | Schafer | 225/52 |
| 5,141,171 | 8/1992 | Yang | 242/493 |
| 5,205,455 | 4/1993 | Moody | 206/409 |
| 5,219,126 | 6/1993 | Schutz | 206/409 |
| 5,346,064 | 9/1994 | Rizzuto | 206/409 |
| 5,370,338 | 12/1994 | Lewis | 242/593 |

FOREIGN PATENT DOCUMENTS

| | | | |
|---|---|---|---|
| 2073931 | 1/1993 | Canada | 242/593 |
| 0107487A1 | 5/1984 | European Pat. Off. | 242/593 |
| 2535696 | 5/1984 | France | 242/593 |
| WO81/02880 | 10/1981 | WIPO | 242/593 |

*Primary Examiner*—John P. Darling

[57] ABSTRACT

An apparatus for containing and dispensing toilet paper. The apparatus holds the toilet paper roll in a stationary position as the loose paper end is pulled from the inner core of the paper roll. A housing for containing the paper roll is attached to a base, and a cover engaged with the housing compresses the paper roll against the base. This compression prevents sag of the layered toilet paper roll as the void in the paper core becomes enlarged.

4 Claims, 1 Drawing Sheet

CENTER FEED TOILET PAPER DISPENSER

BACKGROUND OF THE INVENTION

The present invention relates to an improved apparatus for dispensing toilet paper. More particularly, the present invention relates to a dispenser for statically containing a toilet paper roll and for permitting the selective withdrawal of toilet paper from the stationary roll.

Toilet paper rolls comprise a perforated paper strip wound about a cardboard core. A spindle is inserted through the cardboard core to facilitate the dispensing of the toilet paper. The toilet paper roll rotates about the spindle as toilet paper is unraveled from the exterior surface of the roll. A toilet paper roll section is removed by tearing the roll along a row of perforations.

The cardboard core of toilet paper rolls ultimately becomes a discarded waste product. This waste core creates excess paper waste for landfills, and adds additional shipping weight to the paper product. The increased shipping weight increases product cost and reduces the overall efficiency of toilet paper dispensing.

To remove a piece of toilet paper from a conventional toilet paper holder, the loose end of the toilet paper roll is pulled to rotate the toilet paper roll and cardboard core about the spindle. Two ply paper is typically preferred for this use because a single ply toilet paper roll may prematurely tear. Because the two ply roll contains twice the paper of single ply rolls, for the same number of sheets, two ply rolls are less efficient and therefore waste more paper.

In commercial and public installations, oversized toilet paper rolls are typically stored in oversized paper dispensers. The oversized toilet paper rolls reduce the labor cost incurred in replenishing the rolls, since the oversized rolls hold more paper. However, oversized paper rolls are susceptible to vandalism and overconsumption of the toilet paper. The extra weight of the oversized toilet paper roll experiences a higher angular momentum when the loose toilet paper end is pulled. If the toilet paper does not separate cleanly on this first tug, the entire roll can rotate about the spindle to expose more paper than desired. In maintenance operations, it is not uncommon to discover that vandals have destroyed the utility of a toilet paper roll by spinning an entire toilet paper roll onto the floor.

One effort to create a static paper dispenser for paper towels is illustrated in U.S. Pat. No. 5,065,924 to Granger (1991), wherein paper towels are dispensed from a cylindrical, wall mounted container. As shown in this patent, paper towels are helically withdrawn from the center portion of the paper towel roll along a horizontal axis. To prevent the paper towel roll from sagging within the container, a cylindrical plate is spring biased against one side of the paper towel roll. This cylindrical plate increases the weight, cost, and possibility of mechanical failure of the dispenser. In another embodiment, double sided adhesive strips are adhered to the upper portion of the paper towel roll to prevent sagging. These adhesive strips require labor to install and require mechanical connection to the upper portion of the dispenser.

A need exists for an improved apparatus for dispensing light weight paper products such as toilet paper. Preferably, the apparatus should facilitate the use of lighter weight and economical single ply toilet paper products to prevent economic and material waste.

SUMMARY OF THE INVENTION

The present invention improves the containment and dispensing of light weight paper products such as a cylindrical toilet paper rolls by providing a static roll dispenser that permits the withdrawal of a loose paper end from the center of the roll.

The invention comprises a housing having first and second ends on opposite sides of a curved inner surface. A base is attached to the first end of the housing, and a cover is detachably engaged with the second end of the housing to permit the placement of the toilet paper roll into the housing, and to press the toilet paper roll against the base. An aperture in the cover permits the loose end of the toilet paper to be withdrawn through the cover.

In various embodiments of the invention, the base can be formed integrally with the housing, the base can be attachable to a horizontal surface, and a resilient material can be attached to the cover for contacting the toilet paper roll. In another embodiment of the invention, the aperture can be positioned on the cover to restrict the intrusion of foreign matter into the housing.

DESCRIPTION OF THE PREFERRED EMBODIMENTS

Figure 1:
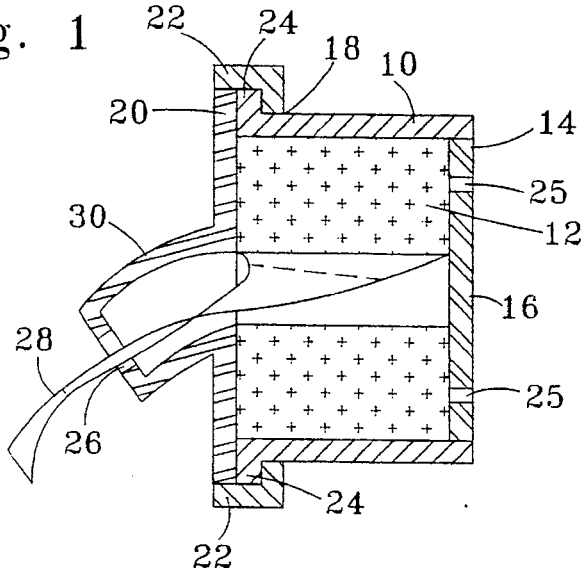
FIG. 1 illustrates a side elevation view in crossection of the present invention.

The present invention provides an apparatus for containing and dispensing a cylindrical toilet paper roll. Referring to FIG. 1, housing 10 is illustrated in conjunction with toilet paper roll 12. As illustrated, toilet paper roll 12 is a conventional toilet paper roll but does not have an inner cardboard core. Housing 10 has first end 14 attached to base 16 and second end 18 attached to cover 20. Clasps 22 detachably engage cover 20 with housing 10.

Figure 2:
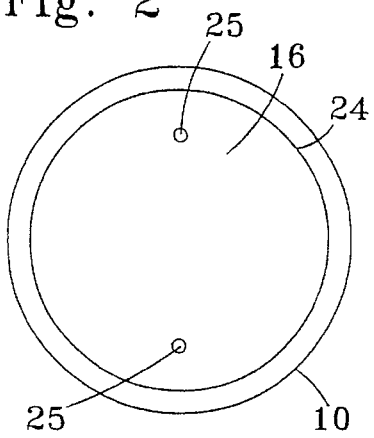
FIG. 2 illustrates a front elevation view of the housing without a cover.

Although clasps 22 are shown as locking clips, clasps 22 can comprise any structural or mechanical configuration capable of engaging cover 20 with housing 10. For example, clasps 22 could comprise hinges or pins for permitting pivotable engagement of cover 20 with housing 10, could comprise male tabs on cover 20 for engaging with female sockets in housing 10, could comprise hooks, screws, bolts, snap rings, clips, and many other physical or structural combinations. As shown in FIG. 1, clasps 22 can engage lip 24 formed in the exterior surface of housing 10. Cover 20 can be permanently connected with housing 10 or can be completely removable as shown in FIG. 2.

Base 16 can comprise a solid member or can comprise a rigid bar or web attached to housing 10. In a preferred embodiment of the invention, base 16 can be formed integrally with housing 10 to eliminate joints therebetween. Base 16 can rest loosely on the top of a horizontal surface (not shown), or can be rigidly fastened to a ceiling, the top of a horizontal surface, or a vertical wall surface. Such attachment can be made with glue or adhesives, with mechanical fasteners such as nails, clips or screws through holes 25, or with known techniques.

As shown in FIG. 1, cover 20 includes opening or aperture 26 to permit the throughput of loose paper end 28. In one embodiment of the invention, aperture 26 is formed in a protrusion such as spout 30, which in turn is attached to or formed in cover 20. Aperture 26 is shown on the lower side of spout 30 to resist the intrusion of foreign matter such as water or dirt into the interior of housing 10. In this embodiment of the invention, spout 30 protects roll 12 by shielding roll 12 from moisture typically found in bathroom and kitchen environments.

Aperture 26 can be sufficiently large to facilitate the retrieval of loose paper end 28 from within housing 10, or aperture 26 can be sufficiently small to prevent the insertion of foreign objects into the interior of housing 10. Aperture 26 can provide a smooth or serrated edge for facilitating the separation of a portion of loose paper end 28 from roll 12. However, the perforated lines defining individual paper sheets in a conventional toilet paper roll provide a separation line in paper end 28 without the need for additional cutting means.

When cover 20 is engaged with housing 10 to enclose roll 12, cover 20 slightly compresses roll 12 by pressing roll 12 against base 16. The amount of such compression can be controlled by modifying the distance between cover 20 and base 16. Alternatively, the amount of such compression can be selectively controlled by attaching inserts to cover 20 or base 16 as more thoroughly described below.

By compressing roll 12, the present invention stabilizes roll 12 within housing 10, and retains roll 12 in a stationary position. Roll 12 is formed from a single paper strip wound into numerous layers. When roll 12 is whole, the individual wound layers of roll 12 provide structural stability to roll 12. As paper end 28 is withdrawn from the inside of roll 12, the circular core space of roll 12 becomes larger, and the span of the arched void in the core of roll 12 becomes larger. As this span is enlarged by the continued withdrawal of paper from roll 12, the upper layers of roll 12 will tend to sag downwardly. If roll 12 is loose in housing 10, the upper layers of roll 12 will eventually collapse, thereby interfering with continued dispensing of loose paper end 28. The present invention overcomes this problem by statically compressing roll 12 to a degree sufficient to prevent this sag.

The static containment of roll 12 permits single ply paper to be used, and permits lighter weight paper to be used. Additionally, the elimination of the cardboard core in conventional toilet paper rolls significantly reduces the weight and expense of the toilet paper roll and handling costs.

Figure 3:
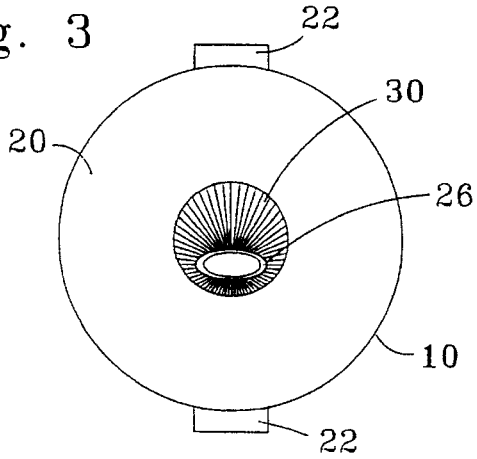
FIG. 3 illustrates a front elevation view of the invention.

As shown in FIG. 3, a front elevation view of the invention is shown wherein cover 20 is attached to housing 10, and loose paper end 28 protrudes through aperture 26. Spout 30 points downwardly in FIG. 3, but could swivel or move independently of cover 20 to permit the selective orientation of aperture 26.

Figure 4:
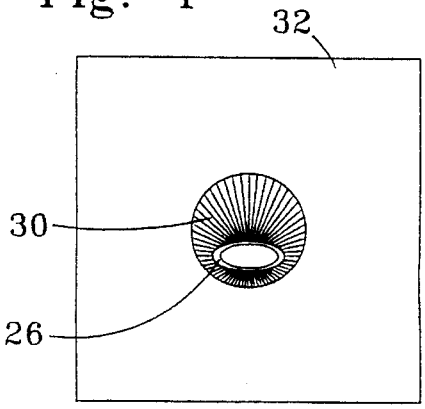
FIG. 4 illustrates a front elevation view of an alternative embodiment of the present invention.

FIG. 4 illustrates an alternative embodiment of the invention wherein the exterior surface of housing 32 is rectangular instead of cylindrical. It will be appreciated that the exterior surface of housing 32 can take many different forms and shapes without affecting the functional result provided by the invention. The inner surface of housing 32 can also be rectangular, since the compression provided by the cover against the base prevents sag of toilet paper roll 12. In another embodiment of the invention, the lower part of housing 32 could be curved to the contour of toilet paper roll 12, while the upper interior surface of housing 32 could be rectangular or another shape.

Figure 5:
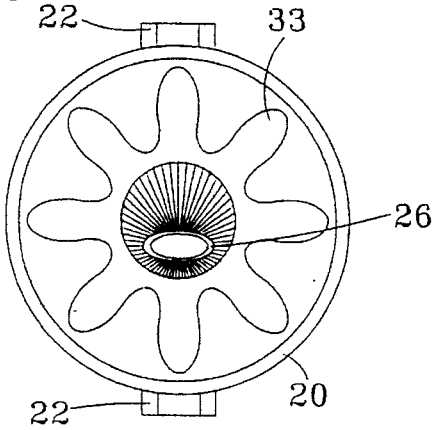
FIG. 5 illustrates a plan view of a cover having an attached flexible material.
Figure 6:
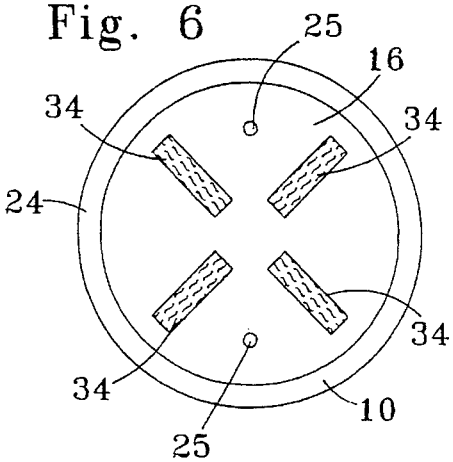
FIG. 6 illustrates a plan view of a base having an attached flexible material.

Different static components can be incorporated into the invention to selectively control the compression provided by the cover and by the base. As shown in FIG. 5, flexible or resilient caulking 33 can be attached to the interior of cover 20 to contact paper roll 12. In another embodiment of the invention shown in FIG. 6, flexible or resilient material such as cushions 34 can be attached to base 16 to affect the compressive force provided between cover 20 and base 16. In other embodiments, other stationary features such as dimples or protrusions can extend from cover 20 or from base 16 to contact toilet paper roll 12.

Although the invention has been described in terms of certain preferred embodiments, it will become apparent to those of ordinary skill in the art that modifications and improvements can be made to the inventive concepts herein without departing from the scope of the invention. The embodiments described herein are merely illustrative of the inventive concepts and should not be interpreted as limiting the scope of the invention.

What is claimed is:

1. An apparatus for the static containment of a cylindrical toilet paper roll having a loose end in the toilet paper roll center, comprising:

a cylindrical housing having first and second ends on opposite sides, wherein the interior surface of said cylindrical housing has a radius substantially corresponding to the outside curved surface of the cylindrical toilet paper roll;

a base attached to and substantially closing the first end of said housing;

a cover detachably engaged with the second end of said housing, wherein said cover is detachable to permit the placement of the toilet paper roll in said housing, and wherein said cover is engagable with said housing to press the toilet paper roll against said base;

an aperture in said cover for permitting the loose end of the toilet paper roll to be withdrawn through said cover; and a resilient material attached to said cover for contacting the toilet paper roll.

2. An apparatus as recited in claim 1, further comprising a resilient material attached to said base for contacting the toilet paper roll.

3. An apparatus for the static containment of a cylindrical toilet paper roll having a loose end in the toilet paper roll center, comprising:

a housing having first and seconds ends on opposite sides of an inner surface for contacting the toilet paper roll;

a base attached to the first end of said housing, wherein said base is formed integrally with said housing and substantially encloses the first end of said housing;

a cover detachably engaged with the second end of said housing, wherein said cover is detachable to permit the placement of the toilet paper roll in said housing, and wherein said cover is engagable with said housing to press the toilet paper roll against said base; and an aperture in said cover for permitting the loose end of the toilet paper roll to be withdrawn through said cover.

4. An apparatus as recited in claim 3 further comprising a resilient material attached to said cover for contacting the toilet paper roll.

* * * * *